US009872569B2

(12) United States Patent
Hasson

(10) Patent No.: US 9,872,569 B2
(45) Date of Patent: Jan. 23, 2018

(54) PORTABLE SEAT ORGANIZER

(71) Applicant: Theodore Aubrey Hasson, Houston, TX (US)

(72) Inventor: Theodore Aubrey Hasson, Houston, TX (US)

( * ) Notice: Subject to any disclaimer, the term of this patent is extended or adjusted under 35 U.S.C. 154(b) by 182 days.

(21) Appl. No.: 15/009,717

(22) Filed: Jan. 28, 2016

(65) Prior Publication Data

US 2016/0213153 A1 Jul. 28, 2016

Related U.S. Application Data

(60) Provisional application No. 62/158,777, filed on May 8, 2015, provisional application No. 62/108,935, filed on Jan. 28, 2015.

(51) Int. Cl.
*A47C 7/70* (2006.01)
*A47C 7/62* (2006.01)

(52) U.S. Cl.
CPC . *A47C 7/70* (2013.01); *A47C 7/62* (2013.01)

(58) Field of Classification Search
None
See application file for complete search history.

(56) References Cited

U.S. PATENT DOCUMENTS 3,632,161 A 1/1972 Arfaras et al.
5,054,837 A 10/1991 Chapman
5,123,707 A 6/1992 Wurzell
5,971,487 A 10/1999 Passehl
6,139,107 A * 10/2000 Lee ..... A47C 1/03 297/411.35
6,142,574 A * 11/2000 Alexander ..... B60N 2/2839 297/188.2
6,260,903 B1 7/2001 Heyde
6,264,273 B1 * 7/2001 Waters, Sr. ..... A47C 7/70 297/188.14
6,336,680 B1 * 1/2002 Lee ..... A47C 1/03 297/411.36
6,419,323 B1 * 7/2002 Chu ..... A47C 1/03 297/411.35
6,827,405 B1 * 12/2004 Roberts ..... A47C 7/546 297/188.18

(Continued)

OTHER PUBLICATIONS

Create-A-Space, Feels like First Class every time you fly, customerservice@createaspace.net, US.

(Continued)

*Primary Examiner* — David E Allred
(74) *Attorney, Agent, or Firm* — The Belles Group, P.C.

(57) ABSTRACT

A portable seat organizer including: a main body having an upper part joined to a lower part by a middle part, the upper part having a first upper surface defining a first plane, and the lower part having a first lower surface defining a second plane, the first and second planes being parallel and not coplanar; an extension plate slidably coupled to the upper part and including at least one of a support slot and a support tab, the extension plate slidable with respect to the upper part in a direction parallel to the first plane and away from the lower part to form an upper extension of the upper part; and a first accessory including a first accessory tab and a first accessory slot to respectively engage the at least one of the support slot and the support tab.

16 Claims, 10 Drawing Sheets

(56) References Cited

U.S. PATENT DOCUMENTS

| | | | | |
|---|---|---|---|---|
| 7,798,072 | B2 | 9/2010 | Becker et al. | |
| 7,841,665 | B2 * | 11/2010 | Geister | A47C 1/03 297/411.36 |
| 8,113,128 | B2 | 2/2012 | Lee | |
| 8,272,674 | B2 | 9/2012 | Vance | |
| 8,474,384 | B2 | 7/2013 | Sundarrao | |
| 8,528,968 | B2 | 9/2013 | Moulton et al. | |
| 8,714,655 | B2 | 5/2014 | Cahall et al. | |
| 8,720,991 | B2 | 5/2014 | Macleod et al. | |
| 9,072,377 | B2 * | 7/2015 | Beimborn | A47B 83/02 |
| 9,434,282 | B2 * | 9/2016 | Kronenberger | B60N 2/44 |
| 2012/0074756 | A1 | 3/2012 | Sayre | |
| 2012/0200124 | A1 | 8/2012 | Beimborn | |
| 2012/0217765 | A1 | 8/2012 | Michael et al. | |
| 2013/0320722 | A1 | 12/2013 | Lavey | |
| 2014/0252811 | A1 | 9/2014 | Whalen | |
| 2014/0252821 | A1 | 9/2014 | Friedlander | |
| 2015/0013737 | A1 | 1/2015 | Daly | |
| 2015/0084393 | A1 | 3/2015 | Chang et al. | |
| 2017/0215593 | A9 * | 8/2017 | Chang | A47C 7/546 |

OTHER PUBLICATIONS

Dorn, Lori, Soaragami, A Portable Armrest Divider That Uses the Principles of Origami to Foster Cooperation Between Passengers, 1995-2015 Laughing Squid LLC, Dec. 12, 2014.

* cited by examiner

PORTABLE SEAT ORGANIZER

CROSS REFERENCE TO RELATED APPLICATIONS

Priority is claimed to U.S. Provisional Application Ser. No. 62/158,777, filed May 8, 2015, and to U.S. Provisional Application Ser. No. 62/108,935, filed Jan. 28, 2015. The disclosures of the aforementioned priority documents are incorporated herein by reference in their entireties.

FIELD OF THE INVENTION

The field of the present invention relates to partitions which may be placed between adjacent seats for providing additional separation between occupants in adjacent seats and to organizers which may be placed adjacent seats for providing additional organizational space to the seat occupant.

BACKGROUND OF THE INVENTION

The seating arrangements in public spaces such as airplanes, trains, theaters, stadiums, and classrooms tend to be designed to strike a balance between fitting the maximum number of people into the space versus comfort. In such public seating arrangements, the occupants of the seats will oftentimes pay a fee, whether directly or indirectly (via taxes), for the right to occupy the seat. Generally speaking, seats which have lower occupation fees also have fewer amenities accompanying the seat. Amenities may include basic amenities, ranging from an armrest, a table top, a cup holder, to higher end amenities, such as a power outlet, a mobile device charging station, a double armrest between adjacent seats, and even a foot rest. For seats which lack one or more basic amenities, it is desirable for an occupant of a seat to be able to bring amenities of their own. However, due to the limited amount space around each individual seat and the temporary occupancy, an occupant can run into difficulties trying to add their own amenities, even basic ones.

For semi-private or fully private seating arrangements, such as a car or in-home theater, a similar lack of amenities may exist. The problem faced by an owner of private seating arrangements, however, is not in finding a way to add amenities for temporary occupancy. Rather, the problem is generally in finding a cost effective way to add even basic amenities to an existing seating arrangement.

SUMMARY OF THE INVENTION

The present invention is directed toward a portable seat organizer that may be used next to many different types of seats, such as those found in airplanes, trains, theaters, stadiums, classrooms, and cars. Generally, the types of seats with which the portable seat organizer works best are those with one seat cushion per seating space. The portable seat organizer enables the occupant of the seat to add accessories to the seating space, including a shelf accessory and a cup holder accessory, among other things. The types of accessories which can be added to a seat space are numerous.

In a first separate aspect of the present invention, a portable seat organizer includes: a main body having an upper part joined to a lower part by a middle part, the upper part having a first upper surface opposite a second upper surface, the first upper surface defining a first plane, and the lower part having a first lower surface opposite a second lower surface, the first lower surface defining a second plane, the first and second planes being parallel and not coplanar; an extension plate slidably coupled to the upper part of the main body and including at least one of a support slot and a support tab, the extension plate slidable with respect to the upper part of the main body in a direction parallel to the first plane and away from the lower part of the main body to form an upper extension of the upper part of the main body; and a first accessory including one of a first accessory tab and a first accessory slot to respectively engage the at least one of the support slot and the support tab.

In a second separate aspect of the present invention, a portable seat organizer includes: a main body having an upper part coupled to a lower part by a middle part, the upper part including a first upper surface defining a first plane; an extension plate slidably coupled to the upper part and including a support slot and a support tab, the extension plate slidable with respect to the upper part in a direction parallel to the first plane and away from the lower part to form an upper extension of the upper part; a first accessory including an accessory tab configured to engage the support slot; and a second accessory including an accessory slot configured to engage the support tab.

In a third separate aspect of the present invention, a portable seat organizer including: a main body having an upper part joined to a lower part by a middle part, the upper part having a first upper surface opposite a second upper surface, the first upper surface defining a first plane and including a plurality of retention receptacles, the lower part having a first lower surface opposite a second lower surface, the first lower surface defining a second plane, the first and second planes being parallel and not coplanar; a pair of guide rails affixed to the first upper surface of the upper part of the main body; an extension plate slidably coupled to the pair of guide rails and including a support slot, a support tab, a locking tab having a protrusion facing the first upper surface of the upper part of the main body, the extension plate slidable with respect to the upper part in a direction parallel to the first plane and away from the lower part to form an upper extension of the upper part, wherein the protrusion engages one of the retention receptacles to maintain the extension plate in selected position with respect to the main body; a first accessory including an accessory tab configured to engage the support slot; a second accessory including an accessory slot configured to engage the support tab; and an armrest stabilizer strap configured to affix to the upper part of the main body and pass around an armrest with the upper part and the lower part extending away from the armrest in opposite directions.

Accordingly, an improved portable seat organizer is disclosed. Advantages of the improvements will be apparent from the drawings and the description herein.

BRIEF DESCRIPTION OF THE DRAWINGS

The foregoing summary, as well as the following detailed description of the exemplary embodiments, will be better understood when read in conjunction with the appended drawings. It should be understood, however, that the invention is not limited to the precise arrangements and instrumentalities shown in the following figures.

DETAILED DESCRIPTION OF THE INVENTION

Figure 1A:
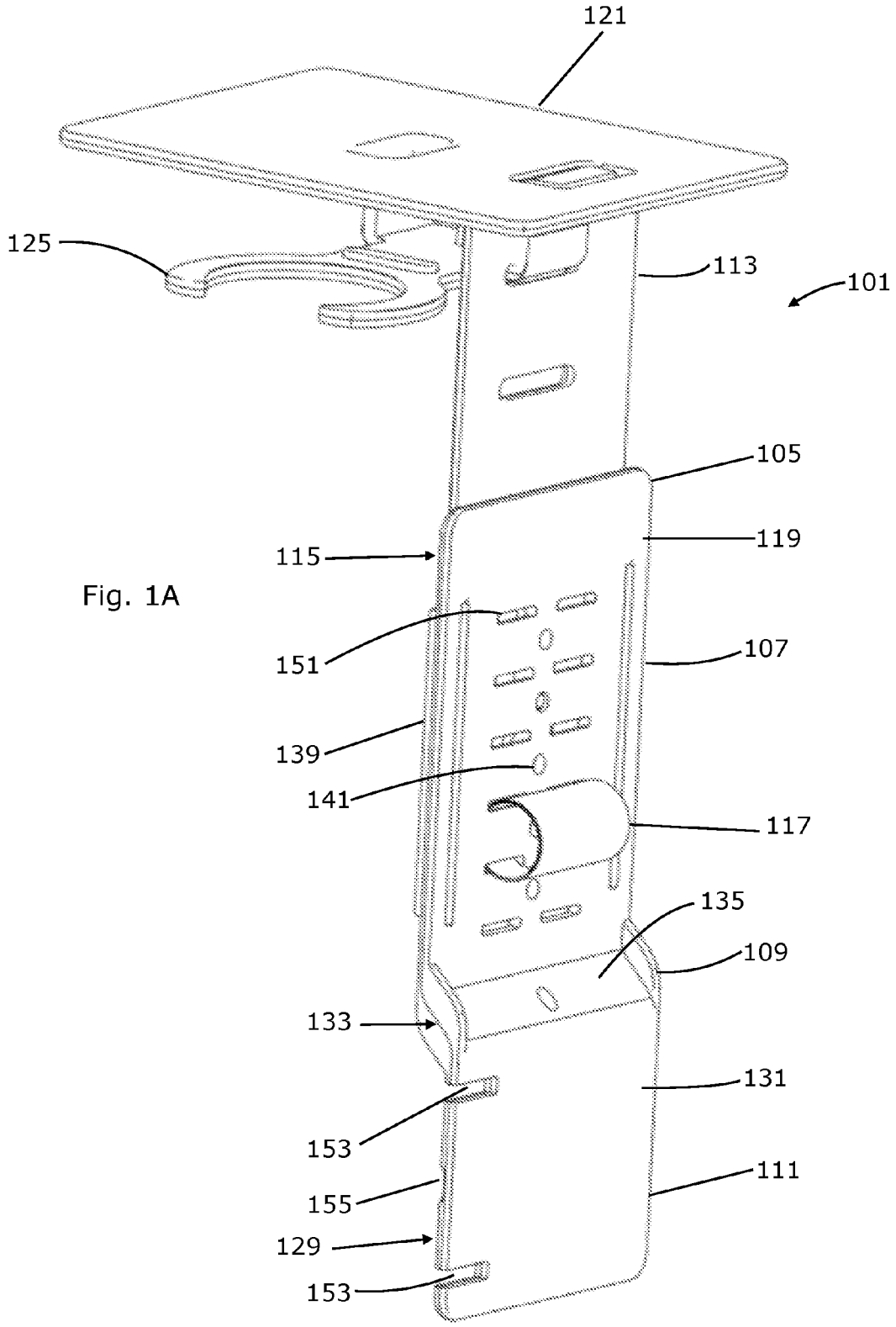
FIG. 1A is a rear perspective view of a first embodiment of a portable seat organizer.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "left," "right," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the preferred embodiments. Accordingly, the invention expressly should not be limited to such preferred embodiments illustrating some possible non-limiting combinations of features that may exist alone or in other combinations of features; the scope of the invention being defined by the claims appended hereto.

Turning in detail to the drawings, a portable seat organizer 101 is shown in FIG. 1. The portable seat organizer 101 may be placed next to a bottom seat cushion and armrest to provide accessories at a seat that is lacking. The portable seat organizer may also serve as a seat partition between occupants of two adjacent seats, thereby providing each occupant with additional privacy and "elbow room." As will become apparent from the description below, the portable seat organizer 101 enables a seat occupant to add a variety of accessories next to a seat. While only a few different types of accessories are depicted herein, a wide variety of accessories may be attached to the portable seat organizer 101. For example, an accessory may include a mirror, a hook for hanging purses or bags, a container for food, a storage space for small items, such as headphones, a reading lamp, and the like. Another type of accessory may include a game board (e.g., a surface for cards, a chess board, a checkers board, a backgammon board, and the like) that is formed on the top surface of an accessory and a storage space for the game pieces on the underside of the top surface. Another type of accessory which may be used is a battery charger for portable devices, such as a backup USB battery charger for a cell phone. The type of accessory and the form factor (e.g., size, shape) of an accessory are practically unlimited and are a matter of design choice.

Figure 1B:
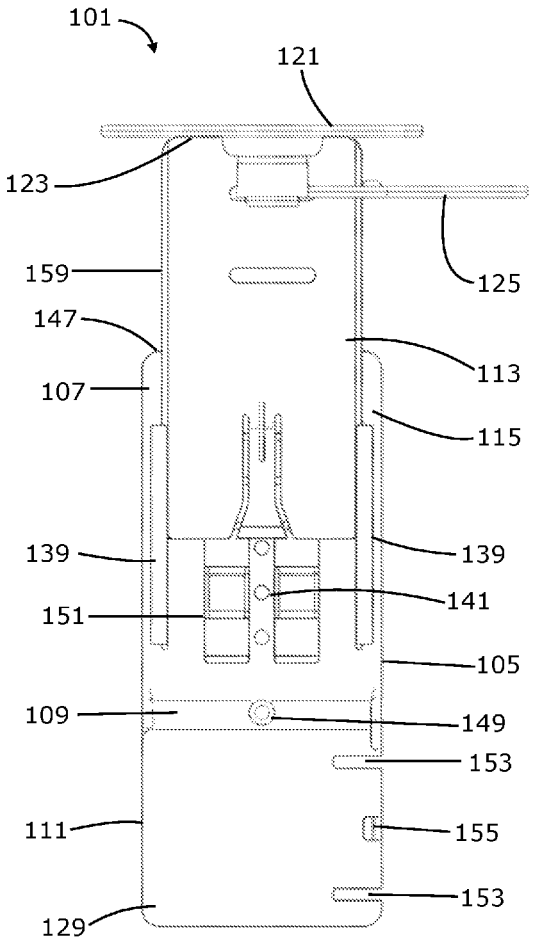
FIG. 1B is a front elevation view of the portable seat organizer of FIG. 1A.
Figure 1C:
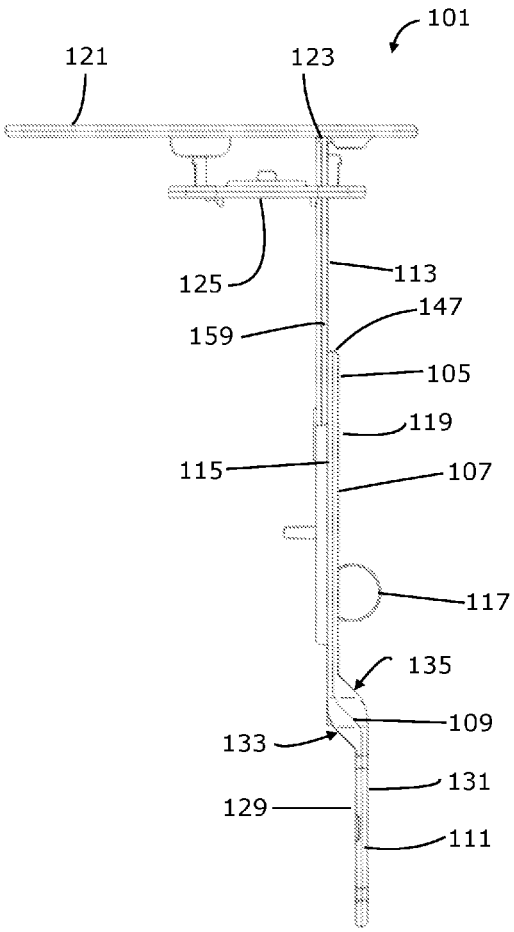
FIG. 1C is a side elevation view of the portable seat organizer of FIG. 1A.

Referring to FIGS. 1A-C, the portable seat organizer 101 includes a main body 105 which has an upper part 107, a middle part 109, and a lower part 111. An extension plate 113 is slidably coupled to a front surface 115 of the upper part 107 of the main body 105, and an armrest stabilizer strap 117 is coupled to the upper part 107. A shelf accessory 121 is coupled to the top edge 123 of the extension plate 113, and a cup holder accessory 125 is coupled to the extension plate 113 just beneath the shelf accessory 121. In certain embodiments, the main body 105, the extension plate 113, the shelf accessory 121, and the cup holder accessory 125, and the constituent parts of each, may each be formed as a separate molded part. In other embodiments, these any one or more of the main body 105, the extension plate 113, the shelf accessory 121, and the cup holder accessory 125 may be formed as an assemblage of sub-parts.

Figures 2A, 2B:
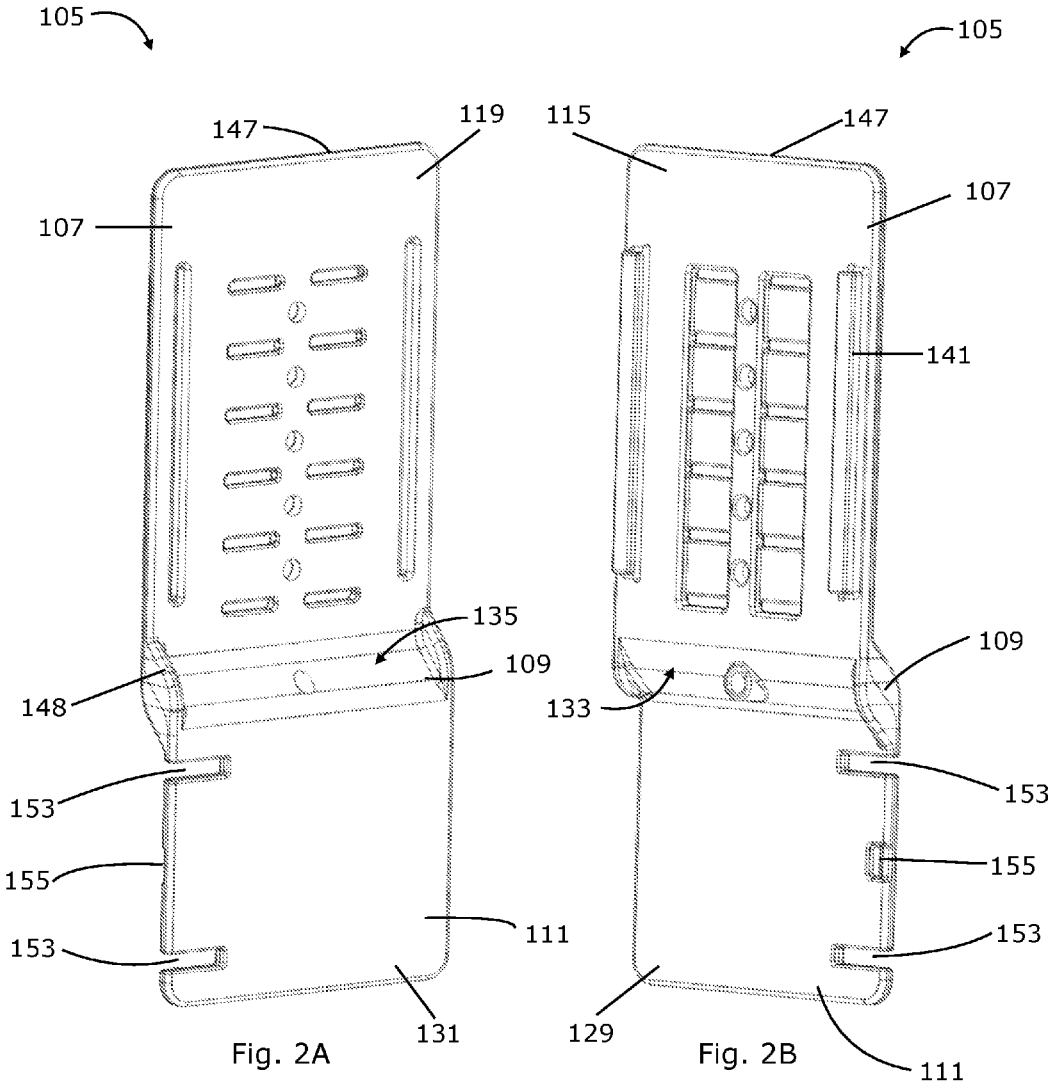
FIG. 2A is a rear perspective view of a main body for the portable seat organizer of FIG. 1A.
FIG. 2B is a front perspective view of the main body for the portable seat organizer of FIG. 1A.

As shown in greater detail in FIGS. 2A-B, the upper part 107 includes a front surface 115 and a rear surface 119. Both the front surface 115 and the rear surface 119 are generally planar, such that each of the front surface 115 and the rear surface 119 defines a reference plane of the upper part 107. In certain embodiments, one or both of the front and rear surfaces 115, 119 may be non-planar, with a reference plane being defined by some other features of the upper part 107 of the main body 105. Similarly, the lower part 111 also includes a front surface 129 and a rear surface 131. Both the front surface 129 and the rear surface 131 are generally planar, such that each of the front surface 129 and the rear surface 131 defines a reference plane of the lower part 111. In certain embodiments, one or both of the front and rear surfaces 129, 131 may be non-planar, with a reference plane being defined by some other features of the lower part 111 of the main body 105. The reference plane of the upper part 107 and the reference plane of the lower part 111 are generally parallel. Having the two reference planes be parallel helps ensure that the upper part 107 remains in a vertical orientation, controlled by the orientation of the lower part 111, when the portable seat organizer 101 is in use.

The middle part 109 serves to couple the upper part 107 to the lower part 111. In the embodiment shown, the middle part 109 includes a bend 133, such that the reference plane of the upper part 107 and the reference plane of the lower part 111 are not coplanar. In certain embodiments, the middle part 109 may couple the upper part 107 to the lower part 111 without the bend 113. In such embodiments, the reference plane of the upper part 107 and the reference plane of the lower part 111 are coplanar.

The bend 133 in the middle part 109 forms a shelf 135 for the main body 105, and the shelf 135 sits under an armrest (see FIG. 7) when the lower part 111 is placed between two seat cushions, or between a seat cushion and another supporting structure. In a typical multi-seat seating arrangement with an armrest, the armrest sits above the point where two adjacent seat cushions abut together. Thus, when the lower part 111 is placed between two adjacent seat cushions during use, the seat cushions on either side of the lower part 111 help stabilize the portable seat organizer 101, and the bend 133 enables the upper part 107 to extend above the armrest while still being maintained in a vertical orientation.

Two guide rails 139 are affixed to the front surface 115 of the upper part 107 of the main body 105. The guide rails 139 couple to the extension plate 113 and enable the extension plate 113 to be slidably coupled to the upper part 107 of the main body 105. The guide rails 139 are oriented so that the extension plate 113 is slidable in a direction toward and away from the lower part 111 of the main body 105. By sliding away from the lower part 111, the extension plate 113 effectively forms an upper extension of the upper part 107 of the main body 105. This allows the attached accessories to be placed at a vertical height above the top of the upper part 107 of the main body 105 when the portable seat organizer 101 is in use. In certain embodiments, only one guide rail may be used, or more than two guide rails may be used to slidably couple the extension plate 113 to the upper part 107 of the main body 105.

The upper part 107 of the main body 105 also includes a plurality of retention receptacles 141. The retention receptacles 141 enable the position of the extension plate 113 to be secured in any one of a plurality of deployed positions, relative to the main body 105, during use. Each of the deployed positions of the extension plate 113 place the top edge 123 of the extension plate 113 at a predetermined height above the top edge 147 of the upper part 107 of the main body 105 (see FIG. 1B). This ensures that the accessories are both height adjustable and able to provide the stability needed for their intended uses (such as holding a cup, a game board, a cell phone, and/or a tablet computer, among other uses).

The middle part 109 of the main body 105 includes another retention receptacle 149. This retention receptacle 149 is provided so that the extension plate 113 may be secured in a stowed position for a nested state of the portable seat organizer 101. The top edge 123 of the extension plate 113 is at its nearest point to the top edge 147 of the upper part 107 of the main body 105 when the extension plate 113 is in the stowed position. The middle part 109 of the main body 105 also includes side buttresses 148 to help reduce the flexibility of the middle part 109.

A plurality of slots 151 are also included in the upper part 107 of the main body 105. The armrest stabilizer strap 117 may be wrapped around an armrest and secured to one or more of the slots 151 the upper part 107 in order to stabilize the portable seat organizer 101 against the armrest. The armrest stabilizer strap 117 may be secured to one or more of the slots 151 using Velcro® or any other type of fastener.

The lower part 111 of the main body 105 includes two stowage slots 153 for coupling to the cup holder accessory 125 as part of the nested state of the portable seat organizer 101. A receptacle 155 if formed within the front surface 129 of the lower part 111, between the stowage slots 153. This receptacle 155 serves to help stabilize the cup holder accessory 125 when coupled to the stowage slots 153.

Figure 3A:
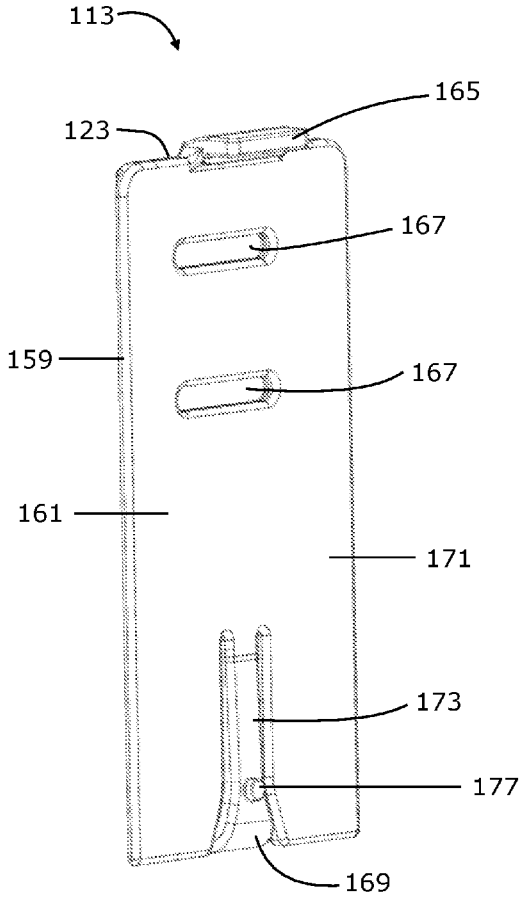
FIG. 3A is a rear perspective view of an extension plate for the portable seat organizer of FIG. 1A.
Figure 3B:
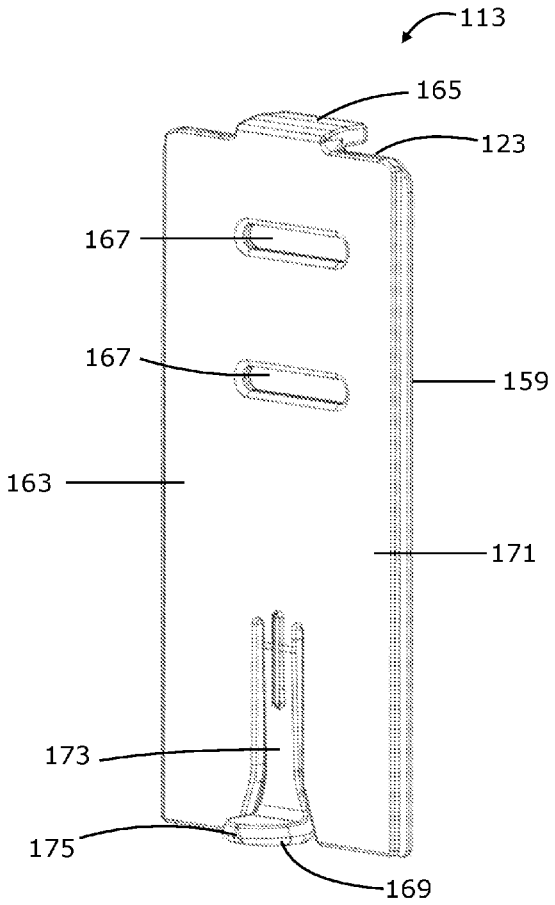
FIG. 3B is a front perspective view of the extension plate for the portable seat organizer of FIG. 1A.

The extension plate 113 is shown in detail in FIGS. 3A-B. The longitudinal sides 159 of the extension plate 113 are configured to be retained under the guide rails 139. The extension plate 113 includes a front surface 161 and a rear surface 163, both of which are planar. In certain embodiments, one or both of the front and rear surfaces 161, 163 may be non-planar. A support tab 165 extends from the top edge 123 of the extension plate 113 in a direction that is orthogonal to the rear surface 163. The support tab 165 is positioned and sized to couple to an accessory slot formed as part of an accessory (see, e.g., FIGS. 5A-B and 9A-B). An accessory may be supported by bearing upward against the support tab 165 while simultaneously bearing downward against the top edge 123 of the extension plate. An accessory may also be supported by being suspended from the support tab 165. Other methods of supporting an accessory from the support tab 165 may also be used.

A plurality of support slots 167 are formed through the front and rear surfaces 161, 163 of the extension plate 113. The support slots 167 are positioned and sized to couple to an accessory tab formed as part of an accessory (see, e.g., FIGS. 6A-B). An accessory may be supported by inserting an accessory tab through one of the support slots 167 and then having the accessory tab bear against either the front surface 161 or the rear surface 163 of the extension plate 113. Other methods of supporting an accessory from one or both of the support slots 167 may also be used. In certain embodiments, the extension plate 113 may include more or fewer support tabs and/or accessory slots than depicted.

A resilient locking tab 169 is included formed as part of body 171 of the extension plate 113. The resilient locking tab 169 includes a spring member 173 and a finger grip 175 at the distal end of the spring member 173. The spring member 173 is resiliently biased to maintain the its position between the planar front and rear surfaces 161, 163 of the extension plate 113. The finger grip 175 extends orthogonally outward from the planar front surface 161 of the extension plate 113 so that a user can flex the resilient locking tab 169. On the rear surface 163 side of the extension plate, the resilient locking tab 169 includes a protrusion 177 which extends out of the planar rear surface 163. The protrusion 177 is sized and shaped to be inserted into and engage the retention receptacles 141 of the upper part 107 and the retention receptacle 149 of the middle part 109 of the main body 105. The resilient locking tab 169, by being resiliently biased, maintains the protrusion 177 in engagement with a selected retention receptacle 141, 149. When a user flexes the resilient locking tab 169, the protrusion 177 is disengaged from the selected retention receptacle 141, 149, thereby enabling the user to slidably move the extension plate 113 with respect to the upper part 107 of the main body 105.

Figure 4:
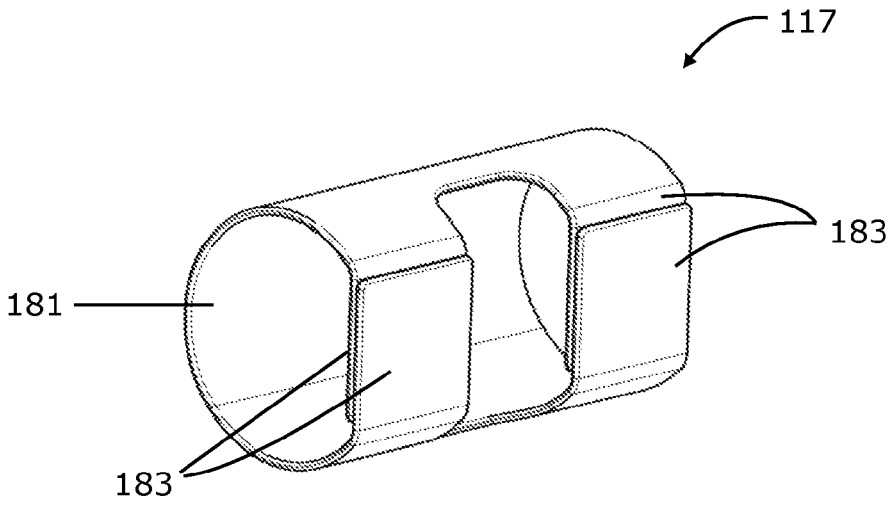
FIG. 4 is a perspective view of an armrest stabilizer strap for the portable seat organizer of FIG. 1A.

The armrest stabilizer strap 117 is shown in detail in FIG. 4. The armrest stabilizer strap 117 includes a strap body 181 and a plurality of strap connectors 183. The strap body 181, which may be formed out of an elastic or an inelastic material, is generally of sufficient length, or stretchable to a sufficient length, to fit around an armrest. Since the overall circumference of armrests may vary, in certain embodiments, the strap body 181 may be adjustable in length. The strap connectors 183 each include complementary Velcro® material so that the end of each strap connector 183 may be secured to another end of the strap connector 183 as shown. In certain embodiments, other types of fasteners may also be used.

Figure 5A:
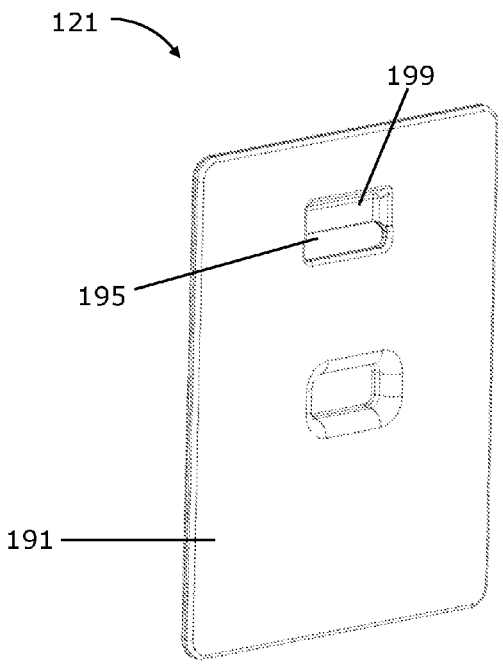
FIG. 5A is a top perspective view of a shelf accessory for the portable seat organizer of FIG. 1A.
Figure 5B:
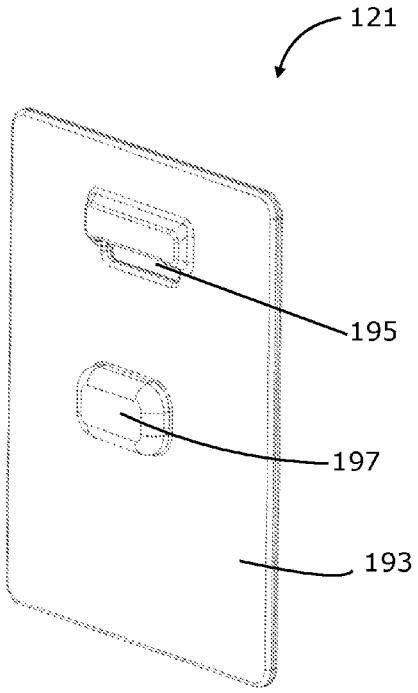
FIG. 5B is a bottom perspective view of the shelf accessory for the portable seat organizer of FIG. 1A.

The shelf accessory 121, which is one type of accessory that may be used with the portable seat organizer 101, is shown in detail in FIGS. 5A-B. The shelf accessory 121 includes a support surface 191, an under surface 193, an accessory slot 195, and a secondary support surface 197. The accessory slot 195 is positioned and sized to couple to the support tab 165 formed as part of the extension plate 113. A bearing surface 199 is formed adjacent the accessory slot 195. When the support tab 165 of the extension plate 113 is inserted into the accessory slot 195 of the shelf accessory 121, the bearing surface 199 provides a surface against which the support tab 165 of the extension plate 113 may bear to maintain the shelf accessory 121 at a desired position (preferably level). The secondary support surface 197 extends out of the under surface 193 to form a second bearing surface for the shelf accessory 121. This secondary support surface 197 may be used when a heavier object is to be placed on the shelf accessory 121. With reference to FIG. 1C, the cup holder accessory 125 is configured to bear against the secondary support surface 197 when the cup holder accessory 125 is coupled to the upper of the two support slots 167 formed in the extension arm 113. In certain embodiments, other types of support accessories may be configured to bear against the secondary support surface 197 when coupled to the extension arm 113.

In certain embodiments, the support surface 191 of the shelf accessory 121, or any other shelf accessory, may include a non-slip material so that items placed on the support surface 191 are more likely to stay in place on the support surface 191 in the event the portable seat organizer 101 is jostled. The non-slip material may also provide cushioning to enhance the non-slip properties. In certain embodiments, the support surface 191 of the shelf accessory 121 may be a non-planar surface, or it may vary in size or shape from that which is depicted. By varying the support surface 191 in various ways, the support surface 191 may be optimized for supporting a wide variety of items, including, but not limited, to the elbow of a user, a phone, a tablet computer, a music player, etc.

Figure 6A:
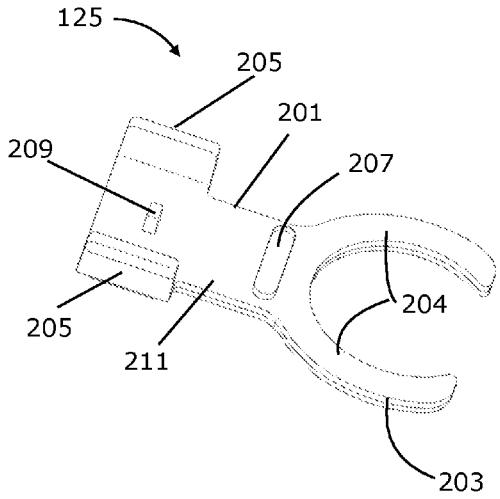
FIG. 6A is a top perspective view of a cup holder accessory for the portable seat organizer of FIG. 1A.
Figure 6B:
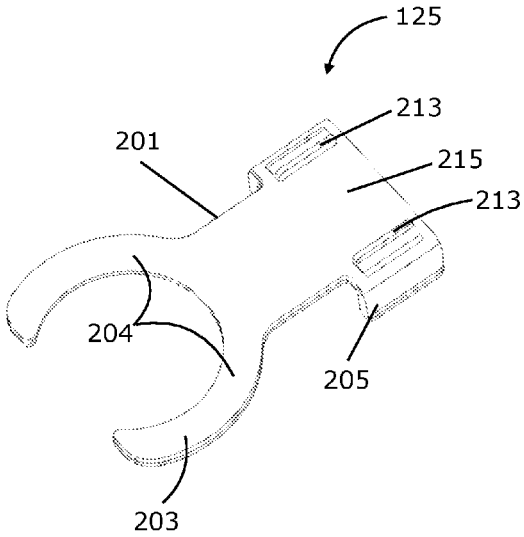
FIG. 6B is a bottom perspective view of the cup holder accessory for the portable seat organizer of FIG. 1A.

The cup holder accessory 125, which is another type of accessory that may be used with the portable seat organizer 101, is shown in detail in FIGS. 6A-B. The cup holder accessory 125 includes a body section 201, a cup holding section 203, and two accessory tabs 205. The cup holding section 203, as shown is formed as a pair of arcuate arms 204 formed to receive and hold a cup and/or bottle. In certain embodiments, the cup holding section 203 may be formed and/or configured to accommodate different sized cups and/or bottles. Those of skill in the art will recognize that any type of cup holder may be designed with an appropriate accessory tab or an accessory slot to form a cup holder accessory which may be affixed to the extension plate 113. A first nib 207 and a second nib 209 protrude from the upper surface 211 of the body section 201. These nibs 207, 209 help stabilize the cup holder accessory 125 when coupled to the stowage slots 153 of the lower part 111 of the main body 105 when the portable seat organizer 101 is in the nested state. When in the nested state (see FIGS. 9A-C), the first nib 207 bears against the surface of another accessory, and the second nib 209 seats within the receptacle 155 formed in the lower part 111 of the main body 105. The accessory tabs 205 extend orthogonally from the upper surface 211 of the body section 201. The accessory tabs 205 are positioned and sized to couple to the support slots 167 of the extension plate 113. Stabilizer bars 213 are formed in the lower surface 215 of the body section 201, with each stabilizer bar 213 being adjacent one of the accessory tabs 205. When one of the accessory tabs 205 is inserted into one of the support slots 167 of the extension plate 113, the inserted accessory tab 205 bears against one of the front or rear surfaces 161, 163 of the extension plate 113, and the adjacent stabilizer bar 213 bears against the other of the front or rear surfaces 161, 163. By bearing against both the front and rear surfaces 161, 163 of the extension plate 113, the cup holder accessory 125 is provided with additional stabilization to support a cup without spilling any liquid that may be contained therein and to provide additional stabilizing support to the shelf accessory 121 (as is shown in FIG. 2C).

Figure 7:
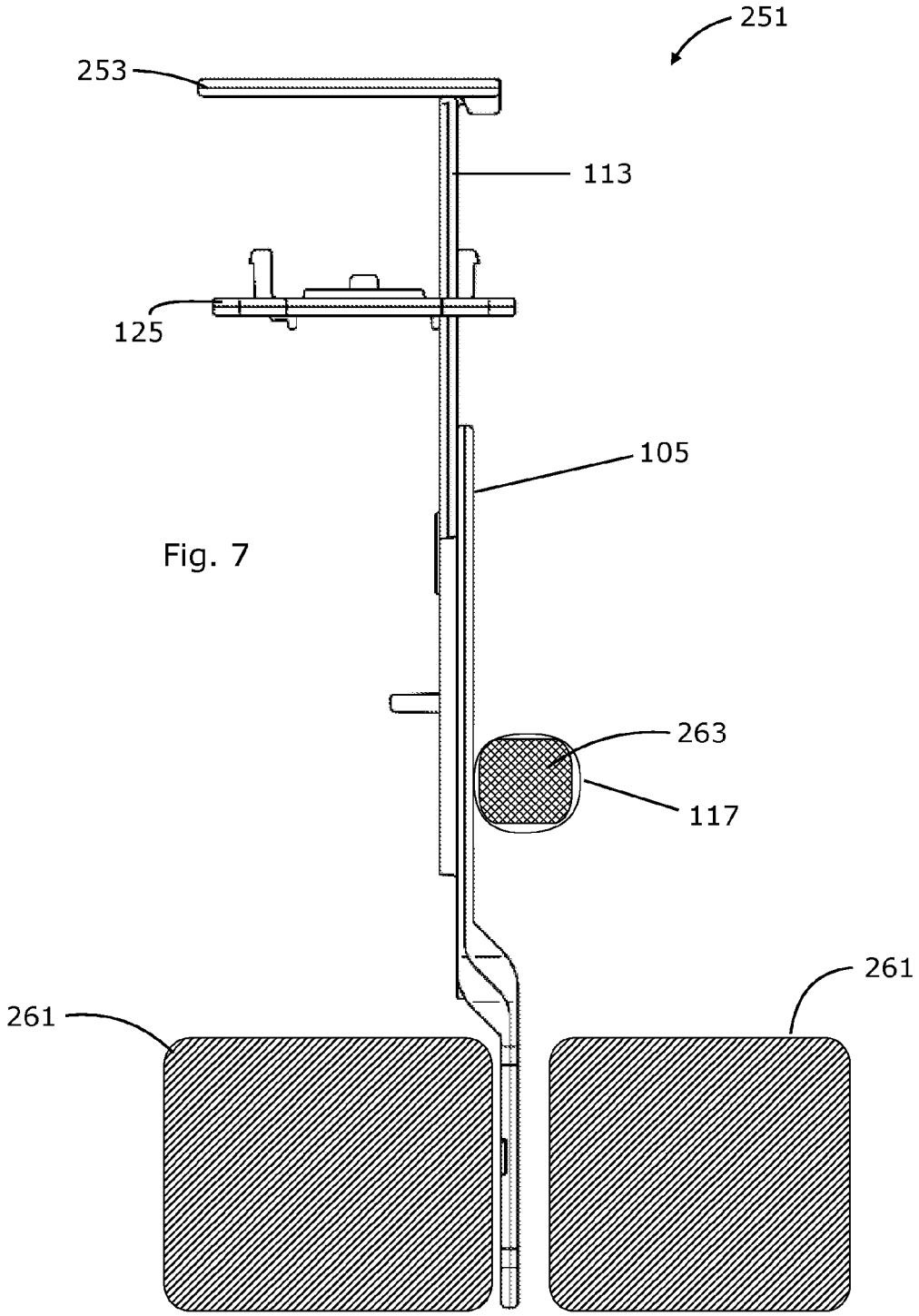
FIG. 7 is a side elevation view of a second embodiment of a portable seat organizer, shown in position with the bottom part of the main body between a seat and an adjacent structure and an armrest stabilizer strap in position around an armrest.

A second embodiment of a portable seat organizer 251 is shown in FIG. 7. This portable seat organizer 251 differs from the portable seat organizer 101 of FIG. 1 in that it has a shelf accessory 253 which is smaller in size that the shelf accessory 121 shown in FIGS. 5A-B. The portable seat organizer 251 is shown with the lower part 111 of the main body 105 positioned between two seat cushions 261. In certain embodiments, one of the two seat cushions 261 may be a different type of object, such as a wall, a barrier, or even a flat, table-like surface, among other things. The scope of the present invention is not to be limited by the circumstances of use of the disclosed portable seat organizer, unless otherwise indicated in the claims. The armrest stabilizer strap 117 extends around the armrest 263 located between the two seat cushions 261. As can be seen, when the portable seat organizer 251 is in position next to a seat cushion 261, the upper and lower parts 107, 111 of the main body 105 extend away from the armrest 263 in opposite directions.

Figure 8A:
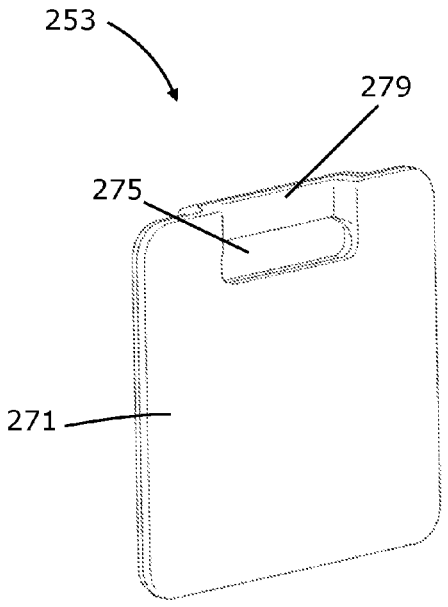
FIG. 8A is a top perspective view of a shelf accessory for the portable seat organizer of FIG. 7.
Figure 8B:
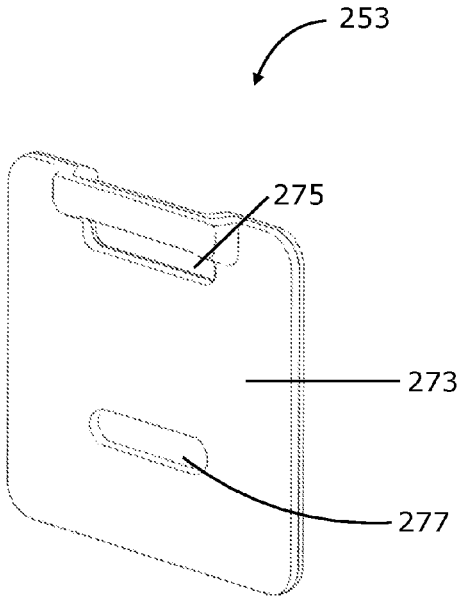
FIG. 8B is a bottom perspective view of the shelf accessory for the portable seat organizer of FIG. 7.

The shelf accessory 253, which is another type of accessory that may be used with the portable seat organizer 251, is shown in detail in FIGS. 8A-B. The shelf accessory 253 includes a support surface 271, an under surface 273, an accessory slot 275, and a stabilizer bar 277. The accessory slot 275 is positioned and sized to couple to the support tab 165 formed as part of the extension plate 113. A bearing surface 279 is formed adjacent the accessory slot 275. When the support tab 165 of the extension plate 113 is inserted into the accessory slot 275 of the shelf accessory 253, the bearing surface 279 provides a surface against which the support tab 165 of the extension plate 113 may bear to maintain the shelf accessory 253 at a desired position (preferably level). The stabilizer bar 276 helps to stabilize the shelf accessory 253 when the portable seat organizer 101 is in the nested state. When in the nested state (see FIGS. 9A-C), the shelf accessory 253 bears against the surface of the cup holder accessory 125.

Figures 9A, 9B, 9C:
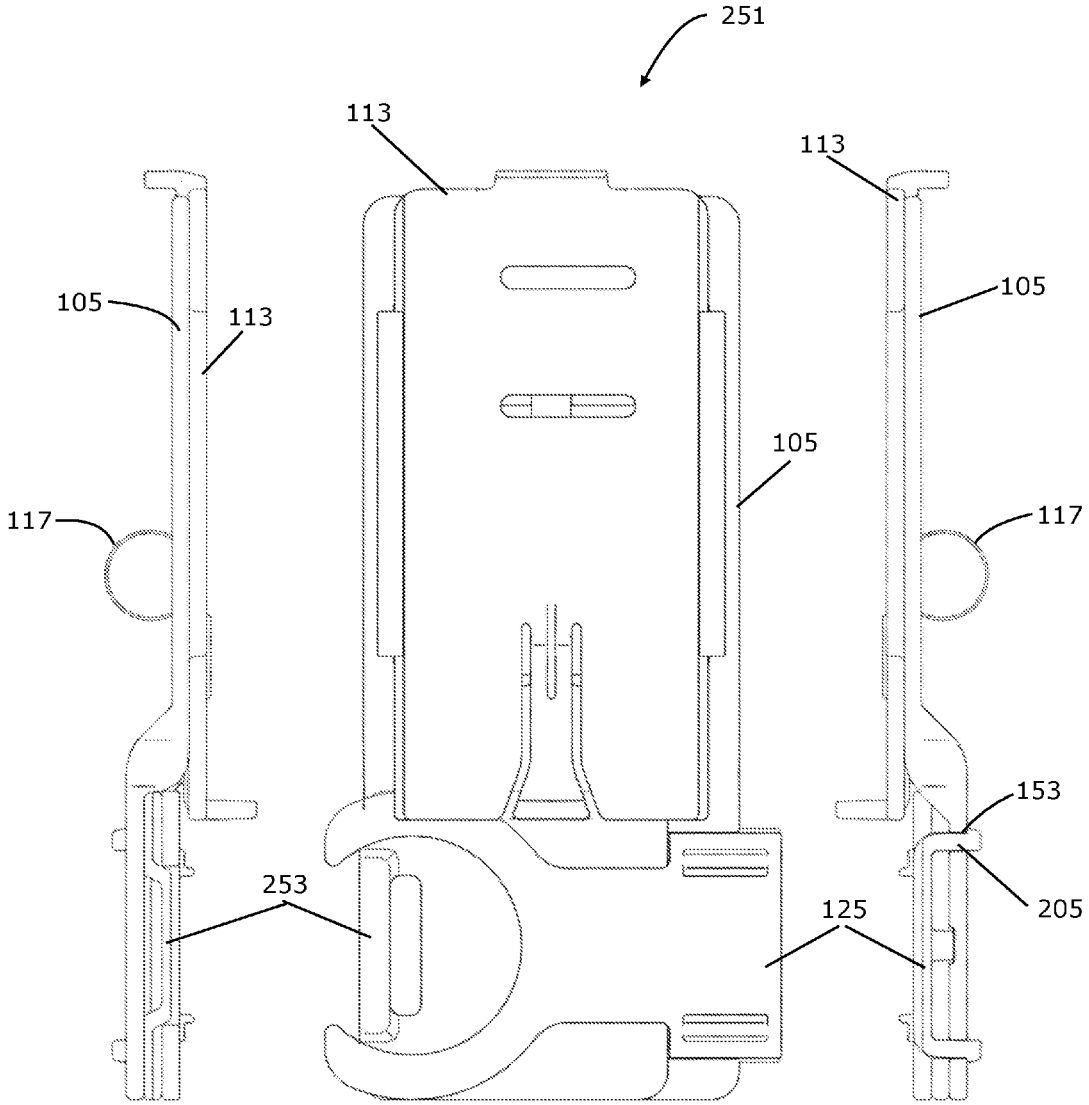
FIGS. 9A-C show top, left side, and right side views of the portable seat organizer of FIG. 7 in a nested state.

The portable seat organizer 251 is shown in FIGS. 9A-C in the nested state. As can be seen in these three views, the extension plate 113 is in the stowed position (as described above with the protrusion 177 engaged with the retention receptacle 149 in the middle part 109 of the main body 105). The accessory tabs 205 of the cup holder accessory 125 are engaged with the stowage slots 153 of the main body 105, and the shelf accessory 253 is stowed between the cup holder accessory 125 and the lower part 111 of the main body 105. In this nested state, the portable seat organizer 251 is substantially in a flattened state which is convenient for storage in a backpack, suitcase, or briefcase. It can also be quickly altered from the nested state to a useable state by sliding the extension plate 113 up, removing the cup holder accessory 125 from the stowage slots 153, and engaging the cup holder accessory 125 and the shelf accessory 253 with the extension plate 113.

The disclosed portable seat organizer has a number of functions for a user who is traveling by plane, although the benefits extend to other circumstances as well: 1) as a barrier between the traveler and the person seated in the adjacent seat, to prevent an intrusion of personal space and to provide additional privacy; 2) to provide a private, exclusive arm rest that does not need to be shared; 3) to provide a surface to place personal items on or place a cup in the optional cup holder; 4) provide a "wall" against which the traveler may lean as an aid for resting; 5) provide a platform, by way of one of the accessories providing a support surface, on which the traveler may lean as an aid for resting; 6) any one or more of the accessories may be attached to both sides of the portable seat organizer, such that certain functionalities of the accessories may be shared with a traveler in an adjacent seat.

Additional features and/or benefits may include:

1) applications include for an airplane, stadiums, theaters, and automobiles, among other types of side-by-side seating arrangements. Different applications may require slight modifications to accommodate the type of seats being used under the circumstances. For example, an automobile version may differ in that portable seat organizer has the upper and lower parts of the main body arranged co-planar, simply because most automobiles do not have existing armrests. Such an embodiment may also be appropriate for use in other circumstances, such as in stadiums or theaters, where the existing armrest is supported by structure extending to the floor, as opposed to structure extending from between the backrests of the seats.

2) The portable seat organizer seat organizer also serves effectively as a partition between occupants in adjacent seats. It does this by effectively providing at least a partial "wall" separating the occupants, thereby providing additional privacy to both occupants, and it leaves the entire armrest between the adjacent seats to the seat occupant who does not install the portable seat organizer. The portable seat organizer can therefore serve to provide additional "elbow room" to the occupants of adjacent seats. The main body of the portable seat organizer may also be constructed with other features to make it more expandable, to provide increased privacy, or less expandable, which would result in less privacy, depending upon the design features incorporated into the portable seat organizer.

3) Multiple portable seat organizers may be used side-by-side to accommodate a seat that is deeper that the portable seat organizer is wide and to provide additional attachment points for accessories.

4) By adjusting the height of the extension plate, a shelf accessory may be configured as an armrest or in an appropriate height position so that the individual sitting in the seat has a comfortable location to place their hand and/or arm for resting or sleeping.

5) Use of the portable seat organizer between two seats with an existing armrest leaves an individual seated in one seat with use of the portable seat organizer, while the individual seated in the adjacent seat still has full use of the existing armrest.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A portable seat organizer comprising:

a main body having an upper part joined to a lower part by a middle part, the upper part having a first upper surface opposite a second upper surface, the first upper surface defining a first plane and including a plurality of retention receptacles, and the lower part having a first lower surface opposite a second lower surface, the first lower surface defining a second plane, the first and second planes being parallel and not coplanar;

an extension plate slidably coupled to the upper part of the main body and including at least one of a support slot and a support tab, the extension plate slidable with respect to the upper part of the main body in a direction parallel to the first plane and away from the lower part of the main body to form an upper extension of the upper part of the main body, the extension plate comprising a locking tab that includes a spring member and a protrusion biased by the spring member into engagement with one of the plurality of retention receptacles for securing the extension plate in a desired position relative to the main body, and wherein the spring member is integrally formed as one piece with the extension plate and the locking tab; and a first accessory including one of a first accessory tab and a first accessory slot to respectively engage the at least one of the support slot and the support tab.

2. The portable seat organizer of claim 1, further comprising at least one guide rail affixed to the first upper surface of the upper part of the main body, the guide rail slidably coupling the extension plate to the upper part of the main body.

3. The portable seat organizer of claim 1, wherein the first accessory comprises one of a shelf accessory and a cup holder accessory.

4. The portable seat organizer of claim 1, further comprising a second accessory including a second accessory tab and a second accessory slot to respectively engage the other of the at least one of the support slot and the support tab.

5. The portable seat organizer of claim 4, wherein the second accessory comprises one of a shelf accessory and a cup holder accessory.

6. The portable seat organizer of claim 1, further including an armrest stabilizer strap configured to affix to the upper part of the main body and pass around an armrest.

7. A portable seat organizer comprising:

a main body having an upper part coupled to a lower part by a middle part, the upper part including a first upper surface defining a first plane and including a plurality of retention receptacles;

an extension plate slidably coupled to the upper part and including a support slot and a support tab, the extension plate slidable with respect to the upper part in a direction parallel to the first plane and away from the lower part to form an upper extension of the upper part, the extension plate comprising a locking tab that includes a spring member and a protrusion biased by the spring member into engagement with one of the plurality of retention receptacles for securing the extension plate in a desired position relative to the main body, and wherein the spring member is integrally formed as one piece with the extension plate and the locking tab;

a first accessory including an accessory tab configured to engage the support slot; and a second accessory including an accessory slot configured to engage the support tab.

8. The portable seat organizer of claim 7, wherein the lower plate includes a first lower surface defining a second plane, the first and second planes being coplanar.

9. The portable seat organizer of claim 7, wherein the lower plate includes a first lower plate side disposed in a second plane, the first and second planes being parallel and not coplanar.

10. The portable seat organizer of claim 7, further comprising at least one guide rail affixed to the first upper surface of the upper part of the main body, the guide rail slidably coupling the extension plate to the upper part of the main body.

11. The portable seat organizer of claim 7, wherein the first accessory comprises one of a shelf accessory and a cup holder accessory.

12. The portable seat organizer of claim 7, wherein the second accessory comprises one of a shelf accessory and a cup holder accessory.

13. The portable seat organizer of claim 7, further including an armrest stabilizer strap configured to affix to the upper part of the main body and pass around an armrest.

14. A portable seat organizer comprising:

a main body having an upper part joined to a lower part by a middle part, the upper part having a first upper surface opposite a second upper surface, the first upper surface defining a first plane and including a plurality of retention receptacles, the lower part having a first lower surface opposite a second lower surface, the first lower surface defining a second plane, the first and second planes being parallel and not coplanar;

a pair of guide rails affixed to the first upper surface of the upper part of the main body;

an extension plate slidably coupled to the pair of guide rails and including a support slot, a support tab, a locking tab comprising a spring member and a protrusion facing the first upper surface of the upper part of the main body wherein the spring member is integrally formed as one piece with the extension plate and locking tab, the extension plate slidable with respect to the upper part in a direction parallel to the first plane and away from the lower part to form an upper extension of the upper part, wherein the spring member biases the protrusion such that the protrusion engages one of the retention receptacles to maintain the extension plate in a selected position with respect to the main body;

a first accessory including an accessory tab configured to engage the support slot;

a second accessory including an accessory slot configured to engage the support tab; and an armrest stabilizer strap configured to affix to the upper part of the main body and pass around an armrest with the upper part and the lower part extending away from the armrest in opposite directions.

15. The portable seat organizer of claim 14, wherein the first accessory comprises one of a shelf accessory and a cup holder accessory.

16. The portable seat organizer of claim 14, wherein the second accessory comprises one of a shelf accessory and a cup holder accessory.

* * * * *